US006299512B1

(12) United States Patent
Costa et al.

(10) Patent No.: US 6,299,512 B1
(45) **Date of Patent: *Oct. 9, 2001**

(54) BELT SANDER WITH ORBITALLY TRANSLATED ABRASIVE BELT

(76) Inventors: Alessandro Costa, Via B. Conte, 10-36015, Schio-VI (IT); Eligio Bau, Via Dante Alighieri, 2-36092, Breganze VI (IT)

( * ) Notice: Subject to any disclaimer, the term of this patent is extended or adjusted under 35 U.S.C. 154(b) by 0 days.

This patent is subject to a terminal disclaimer.

(21) Appl. No.: 09/578,196

(22) Filed: May 24, 2000

Related U.S. Application Data

(63) Continuation-in-part of application No. 09/311,096, filed on May 13, 1999, now Pat. No. 6,089,958.

(51) Int. Cl.[7] ..... B24B 7/02; B24B 21/00
(52) U.S. Cl. ..... 451/59; 451/300; 451/304
(58) Field of Search ..... 451/59, 300, 296, 451/299, 304, 310

(56) References Cited

U.S. PATENT DOCUMENTS 1,628,531 * 5/1927 Carlson .
3,094,815 * 6/1963 Pendergast .
3,553,901 * 1/1971 Burt .
3,665,650 * 5/1972 Przygocki .
3,900,973 * 8/1975 Van Der Linden .
4,267,671 * 5/1981 Rettew .
4,719,721 * 1/1988 Stump .
4,742,650 * 5/1988 Suader et al. .
5,081,794 * 1/1992 Haney .
5,181,342 * 1/1993 Haney .
5,224,300 * 7/1993 Pineau .
5,321,913 * 6/1994 Haney .
5,443,414 * 8/1995 Haney .
5,512,009 * 4/1996 Earl .
5,702,287 * 12/1997 Haney .
6,089,958 7/2000 Costa et al. .

* cited by examiner

*Primary Examiner*—Eileen P. Morgan
(74) *Attorney, Agent, or Firm*—Jenkins & Wilson, P.A.

(57) ABSTRACT

A sanding machine for sanding the surfaces of work pieces placed upon a conveyor that transports the work pieces along a first direction towards and beneath a sanding head. The sanding head comprises a sanding belt entrained around an upper tension roller and a lower contact roller. The tension roller and contact roller are provided with a single translational orbital movement by a pair of eccentric shafts operatively connected thereto and rotatably driven by an operatively connected motor. At least one of the upper tension roller and lower contact roller is also driven by an operatively connected motor so as to provide the endless rotation of the sanding belt around the upper tension roller and lower contact roller. In this fashion, the sanding belt is provided with two contemporaneous superimposed movements consisting of rotational movement about the tension roller and contact roller and a single orbital translational movement imparted by the rotating pair of eccentric shafts. The resulting sanding pattern is homogeneous and renders scratches normally created by the endlessly rotating sanding belt substantially unnoticeable. A second embodiment incorporates an arcuate plate in lieu of the upper roller of the sanding head.

27 Claims, 3 Drawing Sheets

BELT SANDER WITH ORBITALLY TRANSLATED ABRASIVE BELT

RELATED APPLICATION

This application is a continuation-in-part application of U.S. Ser. No. 09/311,096 entitled "Belt Sander with Orbitally Translated Abrasive Belt" filed May 13, 1999, and now U.S. Pat. No. 6,089,958.

TECHNICAL FIELD

The present invention relates generally to machines for abrading material and, more particularly, to an improved sanding machine for providing an enhanced finish on work pieces.

RELATED ART

Motorized sanding machines have been used for many years to sand the upper and lower surface of wooden work pieces that are conveyed along a movable conveyor forming the worktable of the sanding machine. These motorized sanding machines will typically utilize a wide sanding belt that is entrained around vertically spaced rollers. A limitation to these sanding machines is that they will often leave cross-grain scratch patterns in the sanded surface of the wooden work piece that results in an unattractive and perhaps unacceptable finish in the work piece. A further problem relates to movement of the work piece induced by the rotational movement of the rotating sanding belt of the sanding head. Mechanized hand sanders have been used in order to provide an acceptable finish on wooden work pieces, but the sanding operations are highly labor intensive and expensive.

Further, wide belt sanding machines with orbiting abrasive belts are well known to those skilled in the art. Representative wide belt sanders are shown in U.S. Pat. No. 3,832,807 to Kaiser et al. and U.S. Pat. No. 4,719,721 to Stump. Generally, in this type of sanding apparatus, one or more (and typically two) individual sanding heads are utilized wherein each employs an endless wide abrasive belt entrained over individual rollers or drums. At least one of the rollers or drums is power driven to impart a high speed orbital motion to the abrasive belt. Generally, two individual sanding heads arranged in tandem are provided wherein each is disposed vertically above a horizontal conveyor so as to provide operative contact between the upper surface of work pieces being fed through the machine and the surface of the abrasive belt. Further, the first sanding head is typically in the form of a contract drum for dimensioning at the drum stage and the second sanding head is in the form of a platen wherein the finishing occurs at the platen station.

Another type of sanding machine is disclosed in U.S. Pat. No. 4,742,650 to Sauder, Jr. et al. which provides a sanding machine for sanding the surfaces or work pieces placed upon a conveyor that transports the work pieces in a first direction wherein each of two sanding heads is oscillated at two different frequencies relative to the work pieces on the conveyor. The first oscillating frequency orbits the sanding heads in a circular motion over the work pieces on the conveyor, while the second oscillating frequency (which is greater than the first frequency) results in a vibration of the individual sanding elements engaging the work pieces. The double orbital motion sanding machine disclosed in the patent includes a plurality of sander elements transversely spaced above the conveyor, and the sander elements of first sanding head are staggered with respect to the sander elements of the second sanding head. This type of sanding apparatus, however, while useful for many purposes is not as effective for sanding certain types of work pieces as the rotating endless belt sanding head-type of sanding machine.

SUMMARY OF THE INVENTION

In accordance with the present invention, applicants provide a free standing sander for abrading products that includes a sanding head having an endless abrasive belt rotating around an upper roller and a lower roller. A first motor rotates at least of one of the upper and lower rollers of the sanding head so as to cause the abrasive belt to rotate endlessly around the upper and lower rollers. A conveyor is provided adjacent the lower roller of the sanding head to convey the products towards the sanding head while the first motor rotates the abrasive belt of the sanding head around the upper roller and the lower roller. At least one rotatable eccentric shaft is rotatably mounted at one end to the upper roller and to the other end to the lower roller of the sanding head, and a second motor is provided for rotating the at least one eccentric shaft such that rotation of the least one eccentric shaft causes the sanding head to move in a translational orbital movement.

Further, in accordance with the present invention, applicants provide a method of sanding products that includes placing a product on a conveyor belt that moves the product through an abrading area. Next, the product is abraded in the abrading area by a mechanism including a sanding head comprising an endless abrasive belt rotating around an upper roller and a lower roller, a first motor for rotating at least one of the upper and lower rollers of the sanding head where the rotation of the at least one roller causes the abrasive belt to rotate endlessly around the upper and lower rollers, at least one rotatable eccentric shaft rotatably mounted at one end to the upper roller and at the other end to the lower roller of the sanding head, and a second motor for rotating the at least one eccentric shaft such that rotation of the at least one eccentric shaft causes the sanding head to move in a translational orbital movement.

Also, in accordance with the present invention, applicants provide a second embodiment of the free-standing sander and method of sanding products that utilizes an arcuate plate at the top thereof as a substitute for the top roller utilized in the prior embodiment of the inventive free-standing sander and method of sanding products.

It is therefore the object of the present invention to provide an improved sanding machine of the type having a sanding head comprising an endless rotating sanding belt entrained around an upper and lower roller that does not leave cross-grain or otherwise unacceptable scratch patterns in the sanded surface of the work piece.

It is another object of the present invention to provide an improved sanding apparatus of the type having a sanding head comprising an endless rotating sanding belt wherein the sanding head is caused to move in a translational orbital movement.

It is another object of the present invention to provide an improved sanding machine of the type having a sanding head comprising an endless rotating sanding belt that provides a homogeneous sanding pattern on the surface of work pieces processed by the machine.

It is still another object of the present invention to provide an improved sanding machine of the type having a sanding head comprising an endless rotating sanding belt wherein both rotational movement and translational orbital movement are provided to the endless sanding belt in order to render unnoticeable the scratches created by the sanding belt upon the work pieces.

It is still another object of the present invention to provide an improved sanding machine of the type having a sanding head comprising an endless rotating sanding belt that is particularly well adapted for cross-grain sanding of solid wood and veneers in such a way as to eliminate the pattern of longitudinal scratches created by conventional sanding machines utilizing sanding heads with rotating endless sanding belts.

It is still another object of the present invention to provide an improved sanding machine of the type having a sanding head comprising an endless rotating belt which combines a single orbital movement of the sanding head with the conventional rotation of the endless sanding belt of the sanding head.

Some of the objects of the invention having been stated, other objects will become evident as the description proceeds hereinafter, when taken in connection with the drawings described below.

BEST MODE FOR CARRYING OUT THE INVENTION

Figure 1:
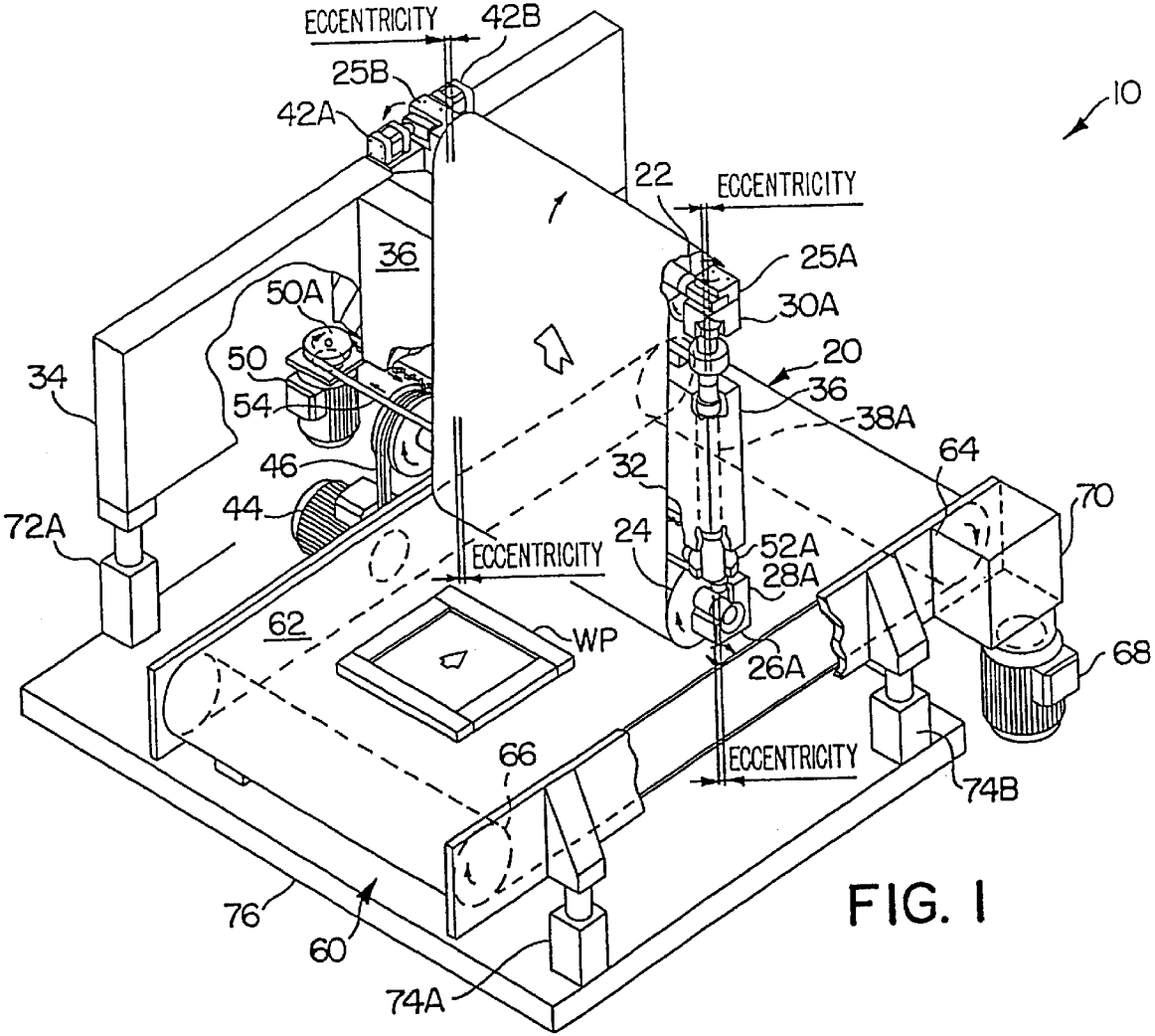
FIG. 1 is a front perspective view of the sanding apparatus of the present invention with parts broken away including parts from the support frame for the sanding head and the bearings for the upper and lower rollers.
Figure 2:
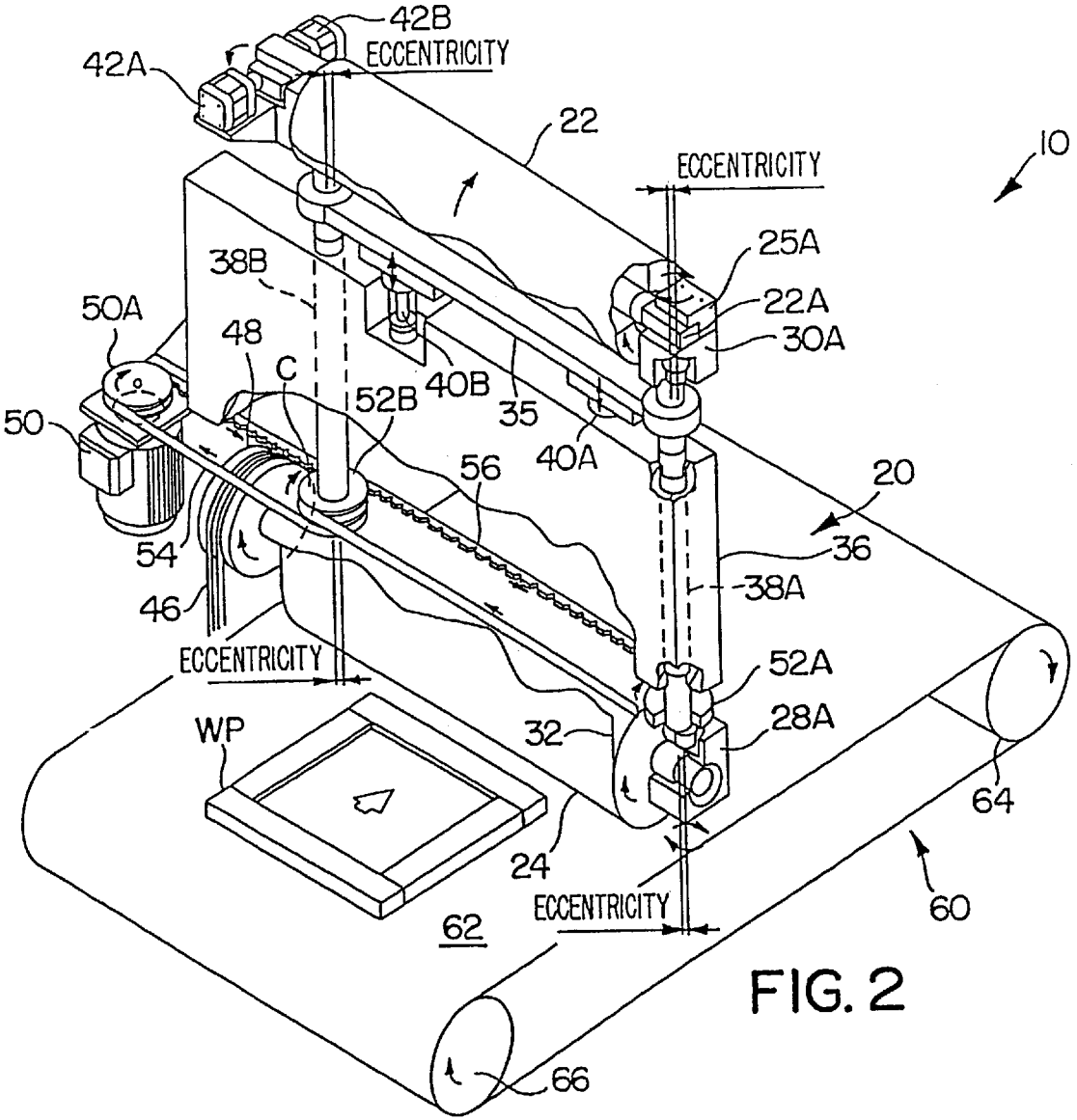
FIG. 2 is a second front perspective view of the sanding apparatus of the present invention with parts broken away including parts from the upper and lower rollers and the support frame therebetween for better clarity of understanding.

With particular attention now directed to FIGS. 1 and 2 of the drawings, the novel rotating belt sanding machine is generally designated 10. Sanding machine 10 includes the sanding head generally designated 20 and the conveyor generally designated 60. Sanding head 20 includes tension roller 22 and contact roller 24. Upper tension roller 22 is supported by bearings 25A and 25B at each end thereof carried by supports 30A and 30B, and lower contact roller 24 is supported by bearings 26A and 26B at each end thereof carried by corresponding supports 28A and 28B at each end of contact roller 24. An endless sanding belt 32 is entrained around upper tension roller 22 and lower contact roller 24. Sanding head 20 is fixedly attached to vertically moveable frame element 34 (only one side of four-sided frame element 34 surrounding sanding head 20 is shown in FIG. 1) by sanding head support element 36 which extends normally outwardly from two opposing sides of frame element 34 and between tension roller 22 and contact roller 24. A pair of spaced-apart and parallel eccentric shafts 38A and 38B are provided to impart translational orbital movement to sanding head 20 in a manner to be described hereinafter. Eccentric shaft 38A extends from contact roller support 28A at its lower end, to tension roller support 30A at its upper end, and eccentric shaft 38B extends from contact roller support 28B at its lower end to tension roller support 30B (not shown) at its upper end. As can be seen with reference to the drawings, eccentric shafts 38A and 38B when rotated will act to provide translational orbital movement to sanding head 20.

With reference to FIG. 2, it can be seen that two actuators 40A and 40B are provided in the top of sanding head support element 36 so as to urge tension roller 22 upwardly or downwardly as required in order to properly tension endless sanding belt 32 entrained around tension roller 22 and contact roller 24. Two pneumatic actuators 42A, 42B are mounted on support 30B of tension roller 22 to automatically center sanding belt 32 by turning the shaft pin 22A. Electric motor 44 drives contact roller 24 by means of belt 46 and pulley 48 mounted to the end shaft of contact roller 24. Second electric motor 50 serves to drive eccentric shafts 38A and 38B by means of pulley 50A mounted to electric motor 50 which drives idle pulley 52B at the end of eccentric shaft 38B by means of toothed belt 54. Idle pulley 52B in turn serves to drive idle pulley 52A at the bottom end of eccentric shaft 38A by means of second toothed belt 56 which extends between idle pulley 52B and idle pulley 52A.

Conveyor 60 comprises endless feed belt 62 for carrying work piece WP beneath sanding head 20 to be acted upon by the combined rotation and orbital movements of sanding belt 32. Feed belt 62 is entrained around driven roller 64 and idle roller 66. Third electric motor 68 is provided to drive driven roller 64 through drive unit 70 which is a conventional gear transmission mechanism.

Finally, with reference again to FIGS. 1 and 2 of the drawings, it can be seen that four-sided frame element 34 to which sanding head 20 is affixed by means of sanding head support element 36 extending between two opposing sides thereof is provided with vertically adjustable movement by means of lifting mechanisms 72A–72D (72B–72D not shown) provided at each end of frame element 34. Lifting mechanisms 72A–72D are most suitably jack posts that act in response to motor actuation (not shown) through a sprocket and chain mechanism (not shown) that is controlled, as desired, by a suitable manual or suitable computer control mechanism (not shown). Conveyor 60 is suitably mounted on support systems 74A–74D (74C–74D not shown) which are most suitably fixed mounting blocks to hold conveyor 60 stationary. Support systems 74A–74D for conveyor 60 are supportably mounted on machine base 76.

Finally, applicants contemplate that counterweights C can be provided on idle pulleys 52A and 52B at the bottom end of eccentric shafts 38A and 38B, respectively, as required in order to suitably balance the eccentric shafts.

I. Use of Novel Sanding Machine

A. Conventional Rotating Belt Sanding Machine

To fully appreciate the advancement of applicants' novel sanding machine that provides simultaneous superimposed movements comprising rotation of the sanding belt about the tension roller and contact roller and translational orbital movement of the sanding belt, applicants note that traditionally the surface sanding of flat panels is performed with conventional belt sanding machines by feeding a work piece into the sanding area by means of a feed belt entrained around a motorized roller and an idle roller. A vacuum hold system can be utilized to apply vacuum to the feed table beneath the feed belt to improve adhesion of a work piece to the feed belt. Normally, the feed belt and support table therebeneath is set at a fixed level from the floor such that the rotating belt sanding head must vertically adjust in order to accommodate different thicknesses of work pieces. However, it is also known to utilize a fixed sanding head with a vertically adjustable feed belt and support table in order to accommodate work pieces of different thicknesses. The sanding action performed by the sanding head on a work piece is obtained by the sanding belt rotating around a contact roller (typically rubber or steel surface) and a tension roller that serves to maintain a proper tension to the sanding belt between the two rollers.

The conventional sanding head is a contact roller (typically with a rubber or steel surface). However, an alternative embodiment of the conventional sanding machine is known that utilizes a pad/platen unit that is formed as a one-piece construction for the entire working width of the unit or that is segmented into various sections with electronic control of the intervention of the various sections of the pad/platen unit.

Convention tension rollers are adapted to be raised or lowered for applying the proper tension to the sanding belt as noted above, and when the tension roller is lowered it will further allow for the substitution or the replacement of the sanding belt as required during use of the sanding machine. Moreover, it is well known for the tension roller to be provided with a swinging movement (in addition to the vertical movement) to maintain proper tracking of the sanding belt on the sanding head during use of the sanding machine. Also, although abrasive endless belts are well known in the sanding machine art, it is also known for the sanding head to utilize other sanding media such as rollers formed of steel, nylon or natural fiber brushes which are all well known in the industry for various abrasive/polishing and uses.

B. Operation of Novel Sanding Machine

Applicants' novel sanding machine 10 combines a single orbital movement of sanding head 20 with the conventional rotation of sanding belt 32 about tension roller 22 and contact roller 24. In use, electric motor 50 rotates eccentric shafts 38A and 38B by means of belt 54 driving pulley 52B which in turn motivates belt 56 so as to drive pulley 52A. The teeth on belts 54 and 56 serve to maintain a constant ratio of rotation of eccentric shafts 38A and 38B by electric motor 50 and pulley 50A connected to the drive shaft thereof. Eccentric shafts 38A and 38B are arranged in phase so that when the shafts are turning the circular trajectories of each shaft 38A and 38B are in phase and the same radius of eccentricity of shafts 38A and 38B is achieved. Eccentric shafts 38A and 38B impart the single translational orbital movement to lower roller supports 28A and 28B and upper roller supports 30A and 30B which in turn impart the single translational orbital movement to eccentric shafts 38A and 38B and to tension roller 22 and contact roller 24.

Thus, sanding belt 32 is subject to two distinct contemporaneous superimposed movements consisting of the rotation movement about rollers 22 and 24 as well as the single translational orbital movement imparted thereto by rotation of eccentric shafts 38A and 38B by electric motor 50. Contemporaneously, electric motor 68 is motivating conveyor belt 62 about driven roller 64 and idle roller 66 and electric motor 44 is imparting rotational movement to sanding belt 32 by imparting rotation to contact roller 24 through belt 46 to pulley 48 connected to the shaft of contact roller 24. In order to accommodate tensioning of sanding belt 32 by vertical adjustment of tension roller 22, eccentric shafts 38A and 38B are splined on the top end (see FIG. 2) to facilitate vertical movement of tension roller 22. To motivate tension roller 22 upwardly and downwardly, two pneumatic actuators 40A and 40B are provided in sanding head support element 36 positioned between tension roller 22 and contact roller 24 and fixedly secured to frame element 34. As noted hereinbefore, automatic centering of sanding belt is accomplished by turning shaft pin 22A with pneumatic actuators 42A and 42B mounted on fixed support 30B for tension roller 22.

Thus, applicants' combination of rotational movement of sanding belt 32 and the simultaneous single translational orbital movement thereof provides an unusually homogeneous sanding pattern on the surface of work piece WP that can render almost unnoticeable the scratches created by sanding belt 32 during working of work piece WP. Although applicants have described the present invention with particular reference to sanding of solid wood or veneered work pieces WP, applicants' inventive sanding machine is intended for other applications including lacquered surfaces, plastic materials, marble, ceramic tiles, stainless steel and copper sheet materials and other type of flat surface work piece materials.

II. Alternative Embodiment of Sanding Machine

Figure 3A:
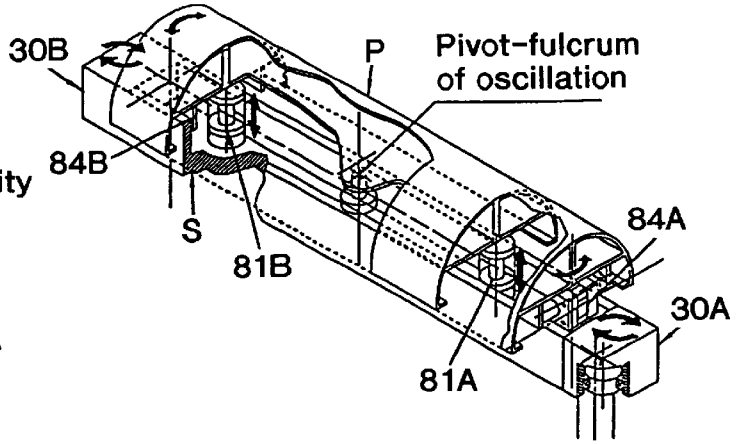
FIG. 3A is a front perspective view of the arcuate plate sanding belt tensioning mechanism shown in FIG. 3 with parts broken away for better clarity of understanding.
Figure 3:
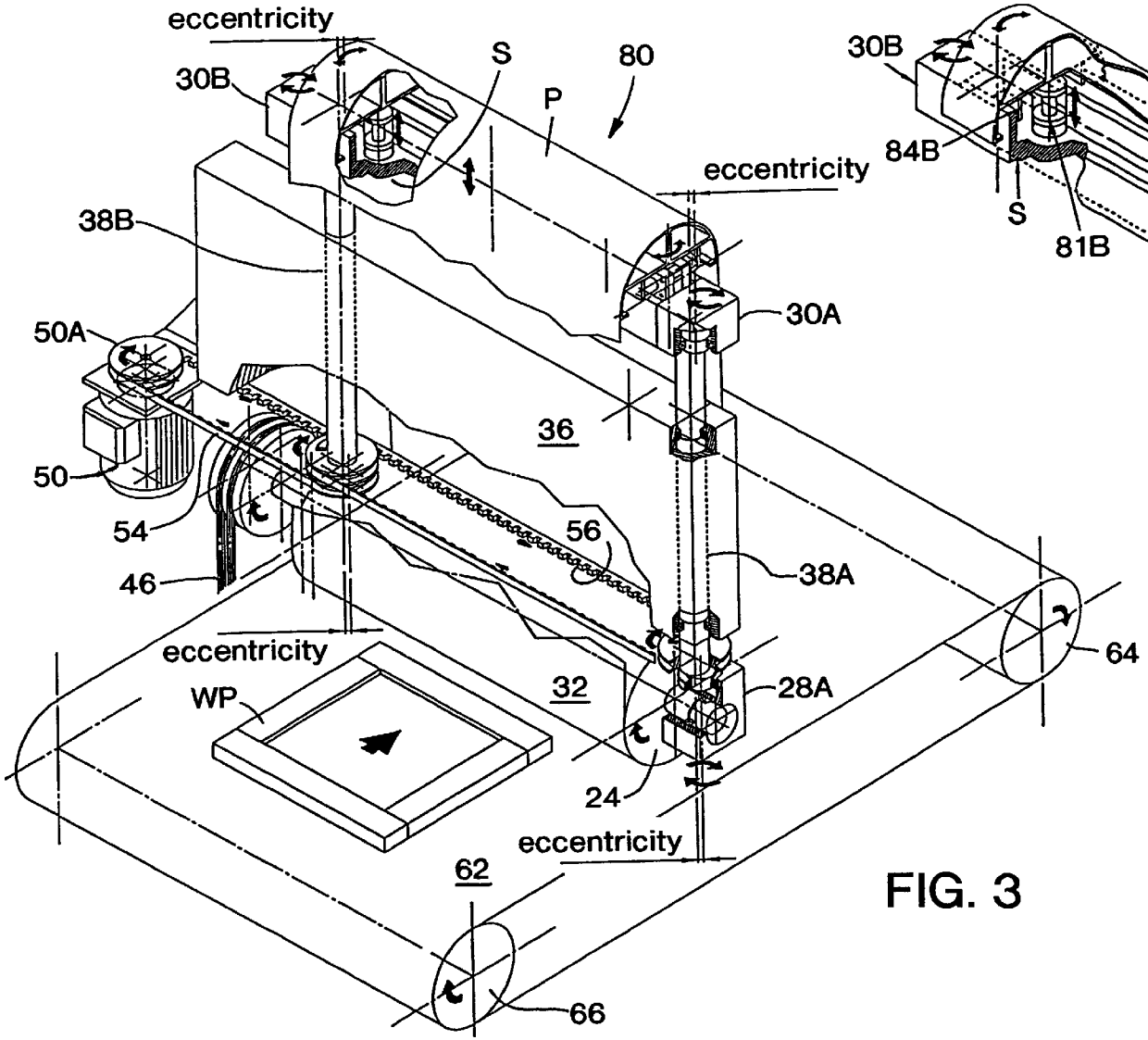
FIG. 3 is a front perspective view of a second embodiment of the sanding apparatus of the present invention with parts broken away for better clarity of understanding.

Referring now to FIG. 3 of the drawings, an alternative embodiment of the novel rotating belt sanding machine is shown and generally designated 80. Sanding machine 80 is shown with like numerals for like parts that are shown in the first embodiment of the sanding machine depicted in FIGS. 1 and 2 of the drawings. Sanding machine 80 is substantially identical to sanding machine 10 shown in FIGS. 1 and 2 of the drawings except for the substitution of an arcuate plate P for upper roller 22 of sanding machine 10. Arcuate plate P is mounted for vertical movement relative to cross support S which is supported at opposing ends thereof by tension roller supports 30A and 30B. The use of arcuate plate P provides an alternative system for tensioning endless sanding belt 32 which is entrained around the stationary arcuate plate P and lower contact roller 24. Similarly to sanding machine 10, sanding machine 80 has two actuators 81A, 81B which are each mounted to cross support S at their lower end and arcuate plate P at their upper end so as to urge arcuate plate P upwardly or downwardly as required in order to properly tension endless sanding belt 32 entrained around arcuate plate P and contact roller 24. Two pneumatic actuators 84A, 84B are mounted on tension roller support S of arcuate plate P to automatically center sanding belt 32 by oscillating the complete arcuate plate P supported in its center, the fulcrum of oscillation. The sanding belt 32 provides the signal of inversion of oscillation through a photocell (not shown) in a conventional manner that is well known to one skilled in the art. (The centering system can be considered similar in principle to the two pneumatic actuators 42A, 42B mounted on support 30B of tension roller 22 in the first embodiment of the invention shown in FIGS. 1 and 2 of the drawings).

Other than the use of the modified tensioning system for sanding belt 32 as described hereinabove in lieu of tensioning roller 22 shown in the first embodiment of the invention depicted in FIGS. 1 and 2 of the drawings, the remaining functions and structural elements of sanding machine 100 are similar to the first embodiment of the invention generally designated 10 in FIGS. 1 and 2 of the drawings.

It will be understood that various details of the invention may be changed without departing from the scope of the invention. Furthermore, the foregoing description is for the purpose of illustration only, and not for the purpose of limitation—the invention being defined by the claims.

What is claimed is:

1. A free-standing sander for abrading products comprising:

(a) a sanding head comprising an endless abrasive belt rotating around an upper arcuate plate and a lower roller;

(b) a first motor for rotating the lower roller of the sanding head, where the rotation of the roller causes the abrasive belt to rotate endlessly around the upper arcuate plate and lower roller;

(c) a conveyor adjacent the lower roller of the sanding head to convey the products toward the sanding head while the first motor rotates the abrasive belt of the sanding head around the upper arcuate plate and the lower roller;

(d) at least one rotatable eccentric shaft rotatably mounted at one end to the upper arcuate plate and at the other end to the lower roller of the sanding head; and (e) a second motor for rotating the at least one eccentric shaft wherein rotation of the at least one eccentric shaft causes the sanding head to move in a translational orbital movement.

2. The sander according to claim 1, wherein the lower roller of the sanding head comprises a driven roller.

3. The sander according to claim 1, wherein the upper arcuate plate is adapted to apply tension to the endless abrasive belt rotating around the upper arcuate plate and the lower roller.

4. The sander according to claim 3, wherein the upper arcuate plate is caused to apply tension to the endless abrasive belt by at least one operatively associated pneumatic actuator.

5. The sander according to claim 1, wherein the sanding head is adapted to move vertically upwardly and downwardly relative to the conveyor to accommodate different size products.

6. The sander according to claim 1, wherein the first motor drivingly rotates the lower roller.

7. The sander according to claim 6, wherein the first motor is connected to the lower roller by a belt and pulley drive.

8. The sander according to claim 1, wherein the conveyor comprises an endless conveyor belt rotating around a driven roller and a freely rotatable idler roller so as to define an upper belt run and lower belt run, and a stationary table being positioned immediately beneath the upper belt run.

9. The sander according to claim 8, including a conveyor drive motor operatively connected to the driven roller by a gear drive.

10. The sander according to claim 8, wherein the conveyor is adapted to move vertically upwardly and downwardly relative to the sanding head to accommodate different size products.

11. The sander according to claim 1, wherein the sanding head comprises an eccentric shaft on each side of the abrasive belt and extending between the upper arcuate plate and the lower roller, wherein each shaft is rotatably mounted at each end thereof in a corresponding upper and lower bearing.

12. The sander according to claim 1, wherein the second motor is connected to the at least one eccentric shaft by a belt and pulley drive.

13. A free-standing sander for abrading products comprising:

(a) a sanding head comprising an endless abrasive belt rotating around an upper arcuate plate and a lower roller;

(b) a first motor for rotating the lower roller of the sanding head, where the rotation of the at least one roller causes the abrasive belt to rotate endlessly around the upper arcuate plate and lower roller;

(c) a conveyor adjacent the lower roller of the sanding head to convey the products toward the sanding head while the first motor rotates the abrasive belt of the sanding head around the upper arcuate plate and the lower roller;

(d) a pair of eccentric shafts comprising an eccentric shaft on each side of the abrasive belt that extends between the upper arcuate plate and the lower roller of the sanding head, wherein each shaft is rotatably mounted at each end thereof in a corresponding upper and lower bearing; and (e) a second motor for rotating the eccentric shafts wherein rotation of the eccentric shafts causes the sanding head to move in a translational orbital movement.

14. The sander according to claim 13, where the lower roller of the sanding head comprises a driven roller.

15. The sander according to claim 13, wherein the upper arcuate plate is adapted to apply tension to the endless abrasive belt rotating around the upper arcuate plate and the lower roller.

16. The sander according to claim 15, where the upper arcuate plate is caused to apply tension to the endless abrasive belt by at least one operatively associated pneumatic actuator.

17. The sander according to claim 13, wherein the sanding head is adapted to move vertically upwardly and downwardly relative to the conveyor to accommodate different size products.

18. The sander according to claim 13, where the first motor drivingly rotates the lower roller.

19. The sander according to claim 18, wherein the first motor is connected to the lower roller by a belt and pulley drive.

20. The sander according to claim 13, wherein the conveyor comprises an endless conveyor belt rotating around a driven roller and a freely rotatably idler roller so as to define an upper belt run and a lower belt run, and a stationary table being positioned immediately beneath the upper belt run.

21. The sander according to claim 20, including a conveyor drive motor operatively connected to the driven roller by a gear drive.

22. The sander according to claim 20, wherein the conveyor is adapted to move vertically upwardly and downwardly relative to the sanding head to accommodate different size products.

23. The sander according to claim 13, wherein the second motor is connected to the at least one eccentric shaft by a belt and pulley drive.

24. A method of sanding products comprising:

(a) placing a product on a conveyor belt that moves the product through an abrading area; and (b) abrading the product in the abrading area by a mechanism having a sanding head comprising an endless abrasive belt rotating around an upper arcuate plate and a lower roller, a first motor for rotating the lower roller of the sanding head where the rotation of the lower roller causes the abrasive belt to rotate endlessly around the upper arcuate plate and lower roller, at least one rotatable eccentric shaft rotatably mounted at one end to the upper arcuate plate and at the other end to the lower roller of the sanding head, and a second motor for rotating the at least one eccentric shaft wherein rotation of the at least one eccentric shaft causes the sanding head to move in a translational orbital movement.

25. The method of sanding according to claim 24, including the step of vertically moving the sanding head to accommodate products of different sizes for sanding.

26. The method of sanding according to claim 24, including the step of vertically moving the conveyor belt to accommodate products of different sizes for sanding.

27. A method of sanding products comprising:

(a) placing a product on a conveyor belt that moves the product through an abrading area; and (b) abrading the product in the abrading area by a mechanism having a sanding head comprising an endless abrasive belt rotating around an upper arcuate plate and a lower roller, a first motor for rotating the lower roller of the sanding head where the rotation of the lower roller causes the abrasive belt to rotate endlessly around the upper arcuate plate and lower roller, a pair of eccentric shafts comprising an eccentric shaft on each side of the abrasive belt that extends between the upper arcuate plate and the lower roller of the sanding head wherein each shaft is rotatably mounted at each end thereof in a corresponding upper and lower bearing, and a second motor for rotating the eccentric shafts wherein rotation of the eccentric shafts causes the sanding head to move in a translational orbital movement.

* * * * *